US005287123A

United States Patent [19]

Medin et al.

[11] Patent Number: 5,287,123

[45] Date of Patent: Feb. 15, 1994

[54] PREHEAT ROLLER FOR THERMAL INK-JET PRINTER

[75] Inventors: Todd R. Medin, Escondido; Richard A. Becker; Brent W. Richtsmeier, both of San Diego, all of Calif.

[73] Assignee: Hewlett-Packard Company, Palo Alto, Calif.

[21] Appl. No.: 878,186

[22] Filed: May 1, 1992

[51] Int. Cl.[5] ..... B41J 2/01

[52] U.S. Cl. ..... 346/140 R

[58] Field of Search ..... 346/25, 140 R; 219/216, 219/469; 101/424.1, 488; 432/60

[56] References Cited

U.S. PATENT DOCUMENTS

| | | | |
|---|---|---|---|
| 4,358,192 | 11/1982 | Goldberg et al. . | |
| 4,385,826 | 5/1983 | Itoh | 432/60 X |
| 4,728,963 | 3/1988 | Rasmussen et al. | 346/25 |
| 4,751,528 | 6/1988 | Spehrley, Jr. et al. | 346/140 R |
| 4,780,078 | 10/1988 | Masui | 432/60 |
| 4,952,781 | 8/1990 | Kozaiku | 219/469 |
| 4,970,528 | 11/1990 | Beaufort et al. | 346/25 |
| 5,021,805 | 6/1991 | Imaizumi et al. | 346/76 |
| 5,041,846 | 8/1991 | Vincent et al. | 346/25 |

FOREIGN PATENT DOCUMENTS

| | | |
|---|---|---|
| 84670 | 6/1980 | Japan . |
| 130864 | 6/1987 | Japan . |

*Primary Examiner*—Joseph W. Hartary

[57] ABSTRACT

A color ink-jet printer having a heating blower system for evaporating ink carriers from the print medium after ink-jet printing. A preheat drive roller engages the medium and draws it to a print zone. The drive roller is heated and preheats the medium before it reaches the print zone. At the print zone, a print heater heats the underside of the medium via radiant and convective heat transfer through an opening pattern formed in a print zone heater screen. The amount of heat energy is variable, depending on the type of the print medium. A crossflow fan at the exit side of the print zone direct an airflow at the print zone in order to cause turbulence at the medium surface being printed and further accelerate evaporation of the ink carriers from the medium. An exhaust fan and duct system exhausts air and ink carrier vapor away from the print zone and out of the printer housing.

15 Claims, 12 Drawing Sheets

PREHEAT ROLLER FOR THERMAL INK-JET PRINTER

RELATED APPLICATIONS

This case is related to Ser. No. 07/876,942, filed May 1, 1992, entitled PRINT ZONE HEATER SCREEN FOR THERMAL INK-JET PRINTER, by T. R. Medin and B. W. Richtsmeier; Ser. No. 07/876,986, filed May 1, 1992, entitled THERMAL INK-JET PRINTER WITH PRINT HEATER HAVING VARIABLE HEAT ENERGY FOR DIFFERENT MEDIA, by B. W. Richtsmeier, T. L. Russell, T. R. Medin and W. D. Meyer; Ser. No. 07/876,939, filed May 1, 1992, entitled AIRFLOW SYSTEM FOR THERMAL INK-JET PRINTER, by T. L. Russell, B. W. Richtsmeier, K. W. Glassett and R. M. Cundiff; and Ser. No. 07/876,924, filed May 1, 1992, entitled HEATER BLOWER SYSTEM IN A COLOR INK-JET PRINTER, by B. W. Richtsmeier, T. L. Russell, T. R. Medin, S. W. Bauer, R. M. Cundiff, and K. L. Glassett.

BACKGROUND OF THE INVENTION

The present invention relates to the field of computer ink-jet printers.

With the advent of computers came the need for devices which could produce the results of computer generated work product in a printed form. Early devices used for this purpose were simple modifications of the then current electric typewriter technology. But these devices could not produce picture graphics, nor could they produce multicolored images, nor could they print as rapidly as was desired.

Numerous advances have been made in the field. Notable among these has been the development of the impact dot matrix printer. While that type of printer is still widely used, it is neither as fast nor as durable as required in many applications. Nor can it easily produce high definition color printouts. The development of the thermal ink-jet printer has solved many of these problems. U.S. Pat. No. 4,728,963, issued to S. O. Rasmussen et al., and assigned to the same assignee as is this application, describes an example of this type of printer technology.

Thermal ink-jet printers operate by employing a plurality of resistor elements to expel droplets of ink through an associated plurality of nozzles. In particular, each resistor element, which is typically a pad of resistive material about 50 μm by 50 μm in size, is located in a chamber filled with ink supplied from an ink reservoir comprising an ink-jet cartridge. A nozzle plate, comprising a plurality of nozzles, or openings, with each nozzle associated with a resistor element, defines a part of the chamber. Upon the energizing of a particular resistor element, a droplet of ink is expelled by droplet vaporization through the nozzle toward the print medium, whether paper, fabric, or the like. The firing of ink droplets is typically under the control of a microprocessor, the signals of which are conveyed by electrical traces to the resistor elements.

The ink cartridge containing the nozzles is moved repeatedly across the width of the medium to be printed upon. At each of a designated number of increments of this movement across the medium, each of the nozzles is caused either to eject ink or to refrain from ejecting ink according to the program output of the controlling microprocessor. Each completed movement across the medium can print a swath approximately as wide as the number of nozzles arranged in a column on the ink cartridge multiplied times the distance between nozzle centers. After each such completed movement or swath, the medium is moved forward the width of the swath, and the ink cartridge begins the next swath. By proper selection and timing of the signals, the desired print is obtained on the medium.

In order to obtain multicolored printing, a plurality of ink-jet cartridges, each having a chamber holding a different color of ink from the other cartridges, may be supported on the printhead.

Current ink-jet technology printers are not able to print high density plots on plain paper without suffering two major drawbacks: the saturated media is transformed into an unacceptably wavy or cockled sheet; and adjacent colors tend to run or bleed into one another. The ink used in thermal ink-jet printing is of liquid base. When the liquid ink is deposited on wood-based papers, it absorbs into the cellulose fibers and causes the fibers to swell. As the cellulose fibers swell, they generate localized expansions, which, in turn, causes the paper to warp uncontrollably in these regions. This phenomenon is called paper cockle. This can cause a degradation of print quality due to uncontrolled pen-to-paper spacing, and can also cause the printed output to have a low quality appearance due to the wrinkled paper.

Hardware solutions to these problems have been attempted. Heating elements have been used to dry the ink rapidly after it is printed. But this has helped only to reduce smearing that occurs after printing. Prior art heating elements have not been effective to reduce the problems of ink migration that occur during printing and in the first few fractions of a second after printing.

Other types of printer technology have been developed to produce high definition print at high speed, but these are much more expensive to construct and to operate, and thus they are priced out of the range of most applications in which thermal ink-jet printers may be utilized.

The user who is unwilling to accept the poor quality must either print at a painfully slow speed or use a specially coated medium which costs substantially more than plain paper or plain medium. Under certain conditions, satisfactory print quality can be achieved at print resolutions on the order of 180 dots per inch. However, the problems such as ink bleeding are exacerbated by higher print. In particular, it has heretofore not been possible to achieve acceptable color printing or throughput on plain paper medium at 180 dots per inch.

Using thermal transfer printer technology, good quality high density plots can be achieved at somewhat reduced speeds. Unfortunately, due to their complexity, these printers cost roughly two to three times as much as thermal ink-jet types. Another drawback of thermal transfer is inflexibility. Ink or dye is supplied on film which is thermally transferred to the print medium. Currently, one sheet of film is used for each print regardless of the density. This makes the cost per page unnecessarily high for lower density plots. The problem is compounded when multiple colors are used.

It is therefore an object of the present invention to provide a color ink-jet printer which prints color images on plain paper which are comparable in quality to color images printed on special papers.

A further object is to provide a plain paper color ink-jet printer characterized by high throughput and reliable, quiet operation.

SUMMARY OF THE INVENTION

A thermal ink-jet printer in accordance with this invention comprises a printhead for printing on a print medium. The printhead includes a plurality of thermal ink-jet nozzles disposed above a print zone for ejecting jets of ink onto the surface of said medium in a controlled fashion. Means are provided for advancing the print medium via a medium path to the print zone during print operations. This advancing means comprises a drive roller for engaging the medium. The medium path comprises a path about a portion of an external circumferential surface of the drive roller. The medium is wrapped about the portion of the external surface of the roller in the course of advancement of the medium to the print zone.

In accordance with this invention, the printer further includes preheat means for preheating the print medium before the medium reaches the print zone, comprising means for heating the roller external surface. In one embodiment, the drive roller is hollow, and the preheat means includes an elongated lamp for generating infrared energy disposed within the roller.

In accordance with another aspect of the invention, the printer further includes means for monitoring the temperature of the external surface of the roller, and means for controlling the preheat means in dependence on the temperature monitoring means to maintain the temperature of the surface at a relatively constant temperature during print operations.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

An exemplary embodiment of a color thermal inkjet printer 50 embodying the invention is illustrated in simplified schematic form in FIGS. 1-17.

OVERVIEW OF THE PRINTER 50

Figure 1:
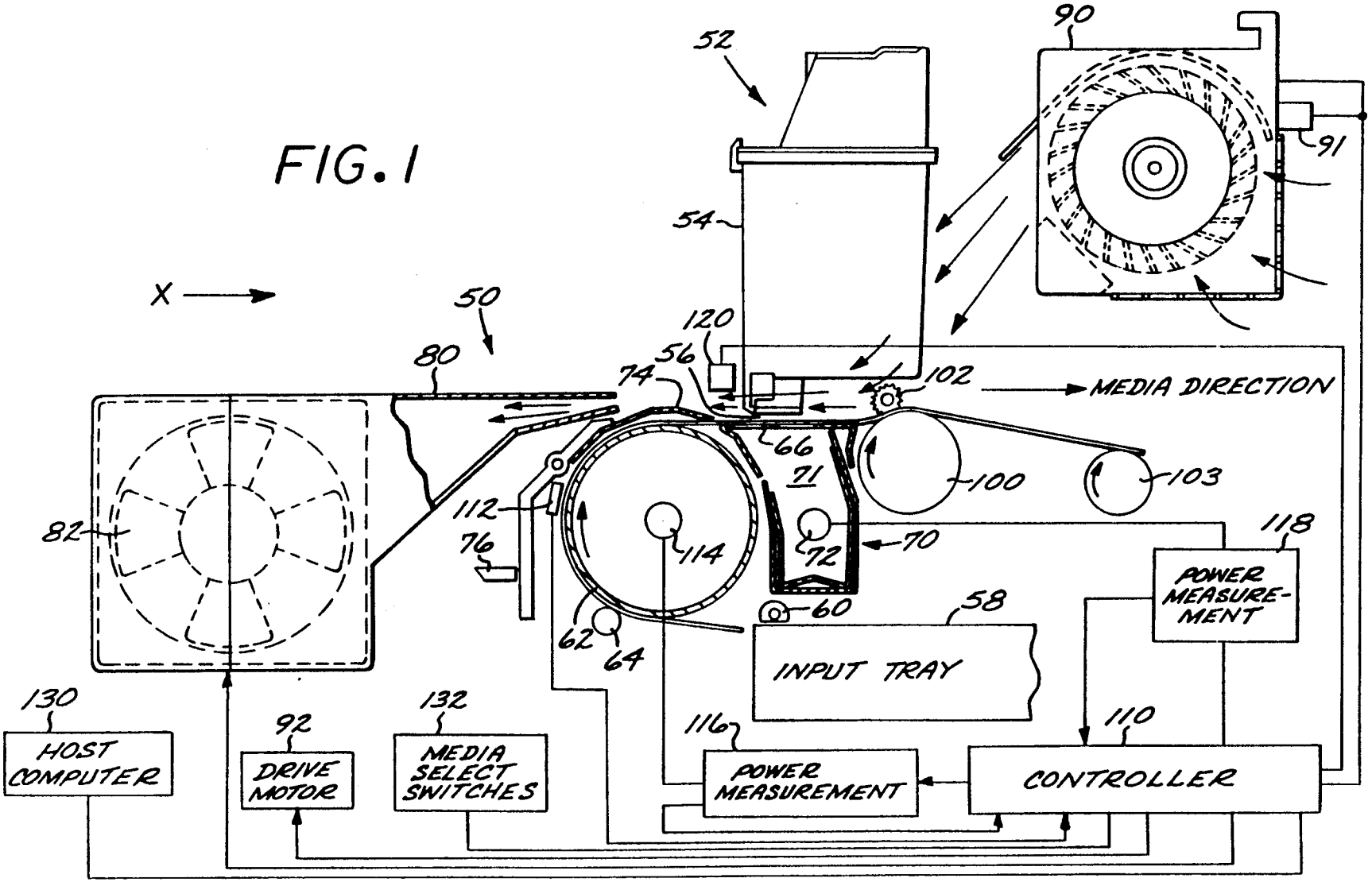
FIG. 1 is a simplified schematic diagram illustrative of a color ink-jet printer embodying the present invention.

The printer includes a means for driving the print medium in the x direction, and for controlling the movement of a printhead, indicated generally as element 52 in FIG. 1, in the y direction (orthogonal to the plane of FIG. 1), in order to direct ink from the ink cartridges, shown generally as elements 54, onto print media at the print region 56. In this embodiment, the printhead 52 supports four ink cartridges for black, yellow, magenta and cyan inks, respectively. This embodiment achieves receptacle color print quality on plain paper media, even using a print resolution of 300 dots per inch. The printhead and its operation are described more fully in the commonly assigned co-pending application entitled "STAGGERED PENS IN COLOR THERMAL INK-JET PRINTER," filed May 1, 1992, Ser. No. 07/877,905, by B. W. Richtsmeier. A. N. Doan and M. S. Hickman, the entire contents of which are incorporated herein by this reference. As described therein, the yellow, magenta and cyan print cartridges are staggered, so that the print nozzles of each cartridge subtend non-overlapping regions at the print zone of the printer.

The ink cartridges 54 each hold a supply of water-based inks, to which color dyes have been added. As presently contemplated, the preferred ink formulation for use in the heated printing environment of the printer of this application is described in U.S. Pat. No. 5,185,034, entitled "Ink-Jet Inks With Improved Colors and Plain Paper Capability," assigned to a common assignee with the present invention, the entire contents of which are incorporated herein by this reference.

The print medium in this embodiment is supplied in sheet form from a tray 58. A pick roller 60 is employed to advance the print medium from the tray 58 into engagement between drive roller 62 and idler roller 64. Exemplary types of print medium include plain paper, coated paper, glossy opaque polyester, and transparent polyester. Preferably the print medium is advanced in the manner described in U.S. Pat. No. 4,990,011, by John A. Underwood, Anthony W. Ebersole and Todd R. Medin, and assigned to a common assignee with the present application. The entire contents of the patent is incorporated herein by this reference. Accordingly, this part of the printer 50 will not be described in further detail herein.

The printer operation is controlled by a controller 110, which receives instructions and print data from a host computer 130 in the conventional manner. The host computer may be a workstation or personal computer, for example. The user may manually instruct the controller 110 as to the type of print medium being loaded via front panel medium selection switches 132. In this exemplary embodiment there are three switches 132, one for plain paper, one for coated paper (e.g., Hewlett-Packard special paper), and another for polyester. The front panel switch selection data is overridden if the data received from the host computer includes medium type data.

Once the print medium has been advanced into the nip between the drive and idler rollers 62 and 64, it is advanced further by the rotation of the drive roller 62. A stepper drive motor 92 is coupled via a gear train to roller 62 to drive the rollers 60, 62, 100 and 103 which drive the medium through the printer media path.

The print medium is fed to a print zone 56 beneath the area traversed by the cartridges 54 and over a print screen 66 which provides a means of supporting the medium at the print position. The screen 66 further allows efficient transfer of radiant and convective energy from the print heater cavity 71 to the print medium as well as providing a safety barrier by limiting access to the inside of the reflector 70.

While the medium is being advanced, a movable drive plate 74 is lifted by a cam 76 actuated by the printhead carriage. Once the print medium reaches the print zone 56, the drive plate 74 is dropped, holding the medium against the screen 66, and allowing minimum spacing between the print nozzles of the thermal ink-jet print cartridges and the medium. This control of the medium in the print zone is important for good print quality. Successive swaths are then printed onto the print medium by the ink-jet head comprising the different print cartridges 54.

A print heater halogen quartz bulb 72 disposed longitudinally under the print zone 56 supplies a balance of thermal radiation and convective energy to the ink drops and the print medium in order to evaporate the carrier in the ink. This heater allows dense plots (300 dots per inch in this embodiment) to be printed on plain paper (medium without special coatings) and achieve satisfactory output quality in an acceptable amount of time. The reflector 70 allows radiated energy to be focused in the print zone and maximizes the thermal energy available.

The printer 50 further includes a crossflow fan 90 located to direct an air flow from in front of the print zone to the print zone, to aid in drying inks and directing carrier vapors toward the evacuation duct 80 for removal.

Figure 16:
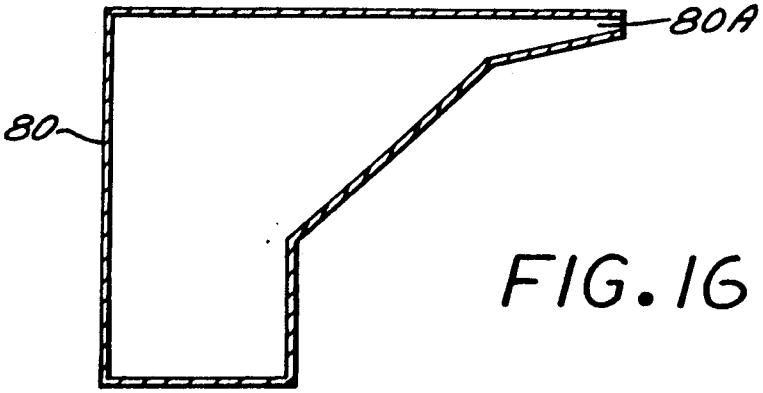

An evacuation duct 80 leads to an evacuation fan 82. The duct defines the path used to remove ink vapors from around the print zone 56. The evacuation fan 82 pulls air and vapor from around the print zone into the duct 80 and out an evacuation opening (FIG. 16). Evacuation of the ink vapors minimizes residue buildup on the printer mechanism.

An exit roller 100 and starwheels 102 and an output stacking roller 103 work in conjunction with the heated drive roller 62 to advance and eject the print medium. The gear train driving the gears is arranged such that the exit roller drives the medium slightly faster than the roller 62 so that the printer medium is under some tension once engaged by the exit roller. The frictional force between the print medium and the respective rollers is somewhat less than the tensile strength of the print medium so there is some slippage of the print medium on the rollers. The tension facilities good print quality keeping the print medium flat under the print zone.

The operation of the various elements of the printer 50 is controlled by controller 110. A thermistor 112 is provided adjacent the drive roller 62 to provide an indication of the temperature of the roller 62 surface. Power is applied to the preheat bulb 114 disposed within the roller 62 via a power measurement circuit 116, permitting the controller to monitor the power applied to the bulb 114. Power is also supplied to the print heater bulb 72 via a power measurement circuit 118, permitting the controller to monitor the power level supplied to the bulb 72. An infrared sensor 120 is mounted adjacent the print zone on the printhead 52, and is used to detect the edges of the print medium and whether the medium is transparent in order to select the appropriate operating conditions for the print neater. The printer supports a special transparent polyester medium, wherein a white opaque strip about 0.5 inches wide is adhered to the back of the medium along its leading edge, extending across the width of the medium. The sensor detects the presence or absence of the strip. By advancing the leading edge of the medium more than 0.5 inches past the sensor, the sharp reduction in energy reflected back to the sensor as the white strip is advanced beyond the sensor indicates that the medium is transparent. The white strip is also used by the sensor to detect the width of the transparent medium.

OVERVIEW OF PRINTER OPERATION

When the printer 50 is turned on, and power is applied to the printer, a warm-up algorithm is initiated. This algorithm turns on the preheat bulb 114 and rotates the drive roller 62 (without any medium in the drive path) so that no hot spots develop on the roller 62, to obtain a uniform roller surface temperature. The preheat temperature is monitored by the controller 110 via the thermistor 112.

Once the printer has come "on line" after being turned on (after various initialization routines and after the warmup algorithm has been performed) and after the print data is received, the print heater starts its preheat algorithm. During the preheat algorithm, the medium is loaded and advanced to the print zone. After the medium edges are sensed, the printing commences and a crossflow fan algorithm is initiated. These algorithms together work to turn on and control the print heater bulb 72, the crossflow fan 90 and the evacuation fan 82 in order to reach the correct operating conditions. Printing is achieved by firing drops of ink from the ink cartridges 54 while they are traversing the medium in a printhead sweep. The carrier in the ink is evaporated by the heat generated by the print heater bulb 72. The carrier vapor is directed by the airflow from the crossflow fan 90 toward the evacuation duct 80, where it is removed through the evacuation fan. The drive roller 62 advances the medium to the next line or sweep to be printed. In the event the print stream is interrupted, the heater 72 is turned off. When all lines have been printed, the print heater bulb 72 and the crossflow fan are turned off and the medium is ejected.

The evacuation fan 82 runs at all times the printer is on and is either printing or ready to print.

THE WARMUP ALGORITHM

Figure 2:
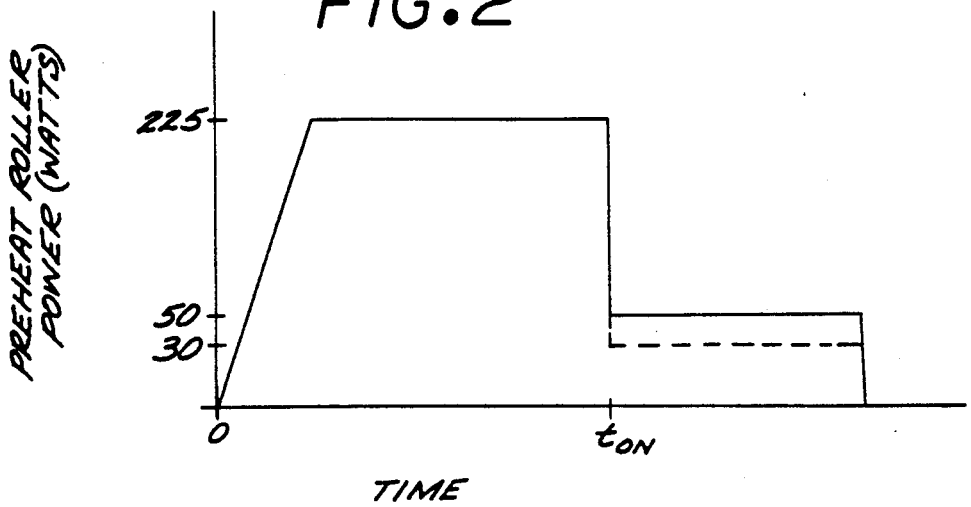
FIG. 2 illustrates the warm-up algorithm for the heated drive roller of the printer of FIG. 1.

The warmup algorithm is illustrated in FIG. 2. When the printer 50 is powered up when the machine is turned on, the power to the preheat bulb 114 is rapidly ramped up to a preheat power setting, which in this embodiment is 225 watts. After some preheat time interval, which is selected in dependence on the temperature sensed by the thermistor 112 when the printer is turned on, the preheat bulb power is reduced to a maintenance power setting. This power setting fluctuates between 30 watts and 50 watts, depending on feedback from the thermistor 112. If the temperature sensed by the thermistor in this embodiment is greater than or equal to 70 degrees C., the power setting is at 30 watts. Once the temperature falls below 70 degrees C., the power setting is increased to 50 watts. The power to the preheat bulb cycles between these two power levels.

In this embodiment, the preheat time interval is selected from the following table, in dependence on the initial temperature sensed by the thermistor 112. The colder the initial temperature reading, the longer will be the preheat time interval.

TABLE I

ROLLER WARMUP TABLE

| Temperature (°C.) | Preheat Time Interval (seconds) |
|---|---|
| ≦40 | 120 |
| 41–45 | 100 |
| 46–50 | 80 |
| 51–55 | 60 |
| 56–60 | 40 |
| 61–65 | 20 |
| ≧66 | 0 |

THE PREHEAT ALGORITHM

Figure 3:
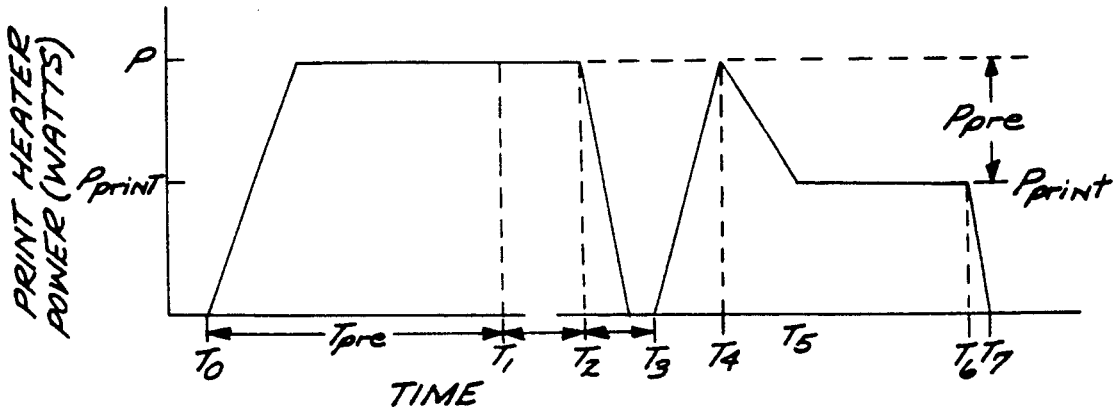
FIG. 3 illustrates the preheat algorithm for the print heater element of the printer of FIG. 1.

FIG. 3 illustrates the preheat algorithm for the heater bulb 72. Once the warmup algorithm of FIG. 2 has completed its warmup phase, and print data has been received from the host computer, the preheat sequence starts at time $T_0$. The power applied to the heater bulb 72 is rapidly ramped up to a preheat power level P. At time $T_1$, loading of the print medium from the storage tray is commenced, and is completed at time $T_2$, whereupon the power to the bulb 72 is turned off. The time interval between $T_1$ and $T_0$, $T_{pre}$, varies in dependence on the medium type, based on the setting of the front panel switches 132 or the print data from the host computer 130.

During the time interval between $T_3$ and $T_2$, the sensor 120 is operated to determine, from the reflectivity of the loaded media, whether the medium is transparent. The heater bulb 72 is turned off from $T_2$ to $T_3$; the operation of the infrared sensor 120 would be affected by the infrared energy generated by the bulb 72 if it was turned on during the sensor reading. This reading will affect the print heater power applied to the bulb 72 during the print process. In an exemplary embodiment, the time interval necessary to perform this sensing operation is about six seconds.

Once the sensing operation is completed, the controller determines the print power to be applied to the bulb 72 in dependence on the medium type. While it is desirable to have a high heater output in order to accelerate the ink drying process, too much heat can cause polyester media to wrinkle and cellulose-based media to turn yellow. Also, excess heat can overheat the print cartridges, resulting in larger drops of ink being expelled during print operations, and causing the cost per copy to increase. If the print cartridges become too hot, the cartridges will stop working. Excessive heat within the printer housing can also cause melting and deforming of plastic components and shorten the life of electronic components.

Some types of print media can withstand higher heat temperatures without adverse effects than other types. In particular, a paper medium can withstand higher heat temperature than a polyester medium; polyester tends to buckle when heated excessively.

At time $T_3$, the bulb power ramped up to P at time $T_4$, and then ramped down to $P_{print}$ at $T_5$. At $T_6$, the print is completed, and the print media ejected from the printer into the output tray.

The power difference between P, the power applied to the bulb 72, and $P_{print}$ is $P_{pre}$. The relationship between these three values is given by the relationships (1) and (2):

$$P=(P_{print})_{sub}+P_{pre}(1-e^{(-1-t_{idle}/\tau)}) \quad (1)$$

for $0 \leqq t_{idle} \leqq 60$ seconds, where $t_{idle}$ is the time interval between successive plots, and $\tau$ is a time constant equal to 15 seconds in this embodiment. $\tau$ is empirically determined by how long it takes the heater to warm up or cool down.

$$P=(P_{print})_{initial}+P_{pre} \quad (2)$$

for $t_{idle}>60$ seconds.

The power applied to the print heater bulb 72 is dependant on the medium type, in accordance with the invention. Exemplary power values for an exemplary printer for different medium types are given in Table II.

TABLE II

| MEDIUM | TYPE | PRINT MODE | $P_{pre}$ (Watts) | RAMP DECREMENT (WATTS/SWATH) | $P_{print}$ (Watts) INIT | $P_{print}$ (Watts) SUBSEQ | $t_{pre}$ (sec.) |
|---|---|---|---|---|---|---|---|
| PAPER | PLAIN | 1 PASS | 105 | 12 | 135 | 125 | 23 |
| | | 3 PASS | 105 | 3 | 135 | 125 | 23 |
| | COATED | 3 PASS | 125 | 3 | 115 | 105 | 23 |
| POLY-ESTER | GLOSSY | 4 PASS | 60 | 1 | 55 | 55 | 25 |
| | OPAQUE TRANSP | 4 PASS | 75 | 1 | 65 | 65 | 13 |

As indicated in Table II, different print modes are employed depending on the medium type. One pass mode operation is used for increased throughput on plain paper. Use of this mode on other papers will result in too large of dots on coated papers, and ink coalescence on polyester media. The one pass mode is one in which all dots to be fired on a given row of dots are placed on the medium in one swath of the print head, and then the print medium is advanced into position for the next swath.

The three pass mode is a print pattern wherein one third of the dots for a given row of dots swath are printed on each pass of the printhead, so three passes are needed to complete the printing for a given row. Typically, each pass prints the dots on one third of the swath area, and the medium is advanced by one third the distance to print the next pass as in the one pass mode. This mode is used to allow time for the ink to evaporate and the medium to dry, to prevent unacceptable cockle and ink bleeding.

Similarly, the four pass mode is a print pattern wherein one fourth of the dots for a given row are printed on each pass of the printhead. For a polyester medium, the four pass mode is used to prevent unacceptable coalescence of the ink on the medium.

Multiple pass thermal ink-jet printing is described, for example, in commonly assigned U.S. Pat. Nos. 4,963,882 and 4,965,593.

In general it is desirable to use the minimum number of passes per full swath area to complete the printing, in order to maximize the throughput. Table II also shows that the rate at which P decreases (i.e., ramp decrement) from its peak at $T_4$ to $P_{print}$ at $T_5$ varies, depending on the medium type. The ramp decrement rate has been empirically determined. For the plain paper medium using the one pass mode, which is typically used only for black only printing with relatively lower dot density, the heat output is higher initially, and the swath time is slower than on the other medium types, since all dots are being fired on a single pass. The higher decrement rate is employed to prevent overheating of the medium and the printer components. For the plain paper using three pass mode, which provides higher print quality, each swath or pass takes less time, and so a lower decrement rate/swath can be employed. Thus, for example, for plain paper, the bulb power is decrement by either 12 or 3 watts per swath, depending on the print mode, while for polyester, the ramp decrement rate is 1 watt/swath. For coated paper, the same decrement rate is used as for plain paper using the three pass printing mode. For polyester, the initial heater power is significantly lower, so the ramp decrement rate can be lower, in order to obtain the necessary heat to dry the ink.

Figure 4:
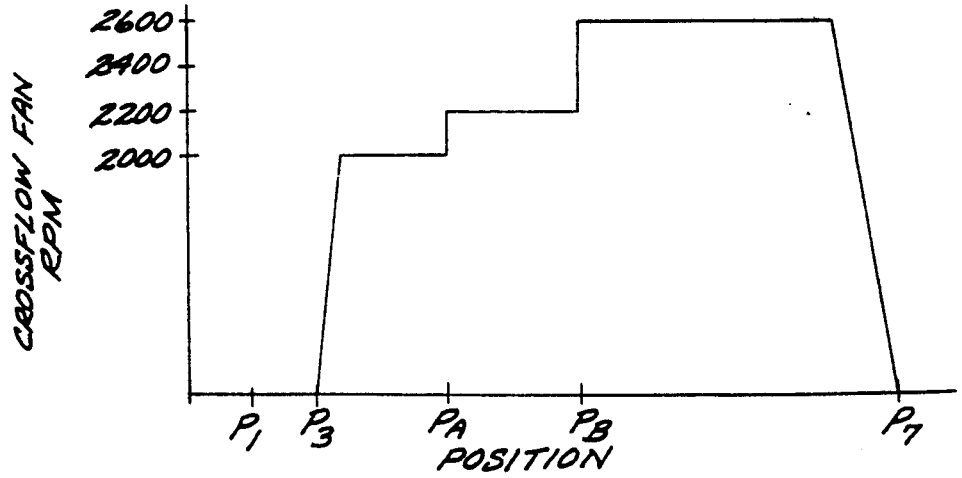
FIG. 4 illustrates the fan speed algorithm for the crossflow fan of the printer of FIG. 1.

FIG. 4 illustrates the crossflow fan algorithm, showing the fan speed for the different print medium positions and type. Positions $P_1$, $P_3$ and $P_7$ correspond to medium positions at the respective times of $T_1$, $T_3$ and $T_7$ of FIG. 3. Thus, at position $P_1$, loading of the print medium is commenced. At position $P_3$, the medium has been advanced to the print zone 56, and printing commences, and at this time the crossflow fan is turned on to 2000 RPM. At position Pa, when the leading edge of the medium is at midscreen, the fan RPM is increased to 2200 RPM. At position Pb, the leading edge of the medium has reached the starwheels and the speed is increased again to 2600 RPM if the medium, is plain paper; otherwise the speed remains constant at 2200 RPM until the printing has been completed at time T6, when the crossflow fan is turned off.

The crossflow fan 90 is not driven at its highest speed until the medium fully covers the screen 66, and the speed is ramped up as the medium advances across the screen. If the fan were to be operated at full speed at the beginning of the print cycle, the fan would blow air through the openings of the screen and into the reflector cavity. This would cool off the print heater and cavity, and reduce the heat energy available to evaporate the ink carrier.

The maximum fan speed is dependent on the print medium, and is determined by ink spray conditions on the media. It is desired to maximize the fan speed to keep the ink cartridges and printer enclosure from getting too hot. However, the air velocity creates ink spray outside the nominal print area, as tiny spray droplets are forced away from major ink drops. The visual threshold acceptability of ink spray is dependent on the medium type. Plain paper is least sensitive to ink spray, and therefore the highest fan speed setting is used for plain paper. A lower maximum fan speed is used for other types of medium, which use a lower heater setting and have less need for cooling anyway.

Figure 5A:
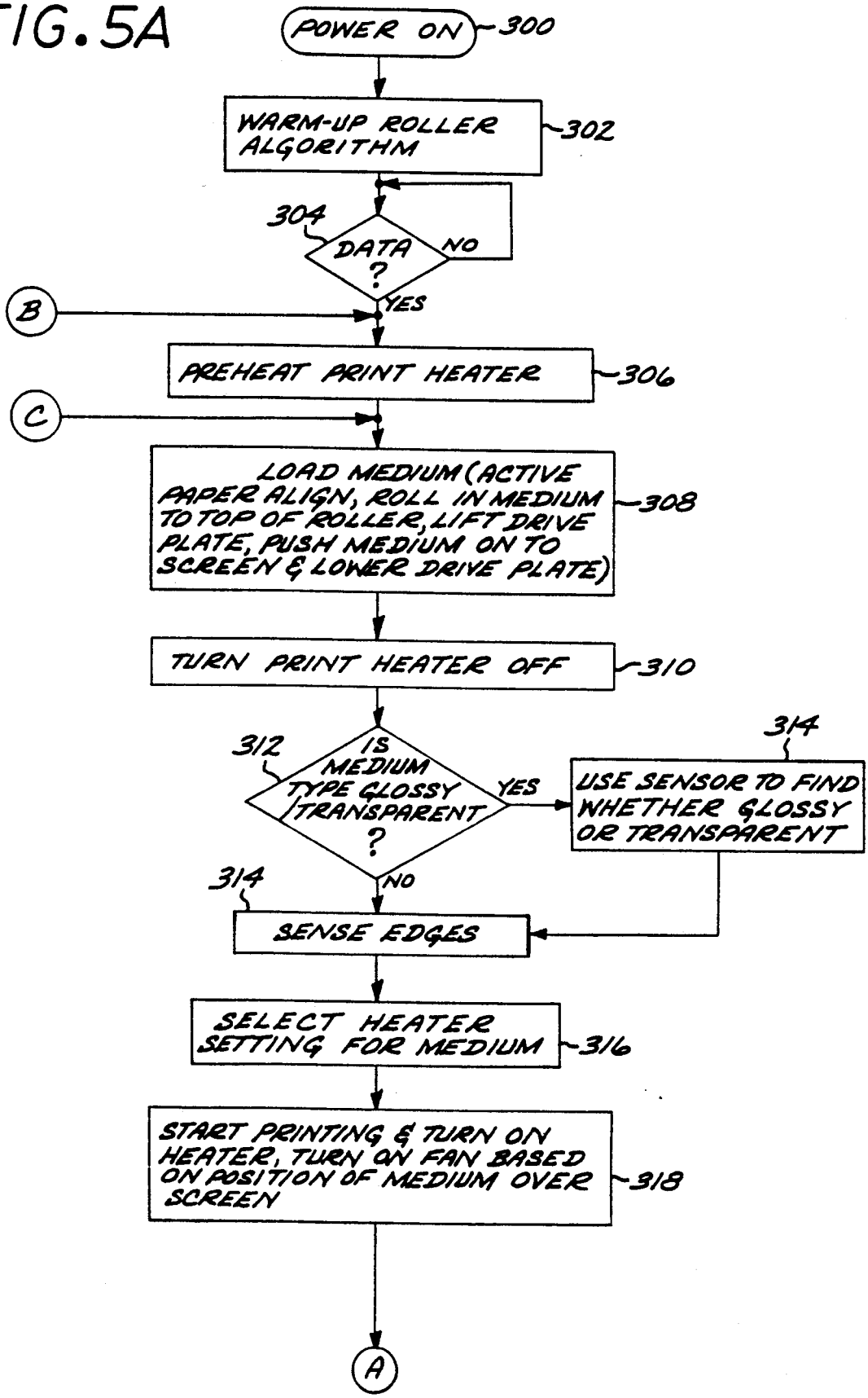
FIGS. 5A and 5B illustrate the control sequence for the printer of FIG. 1.
Figure 5B:
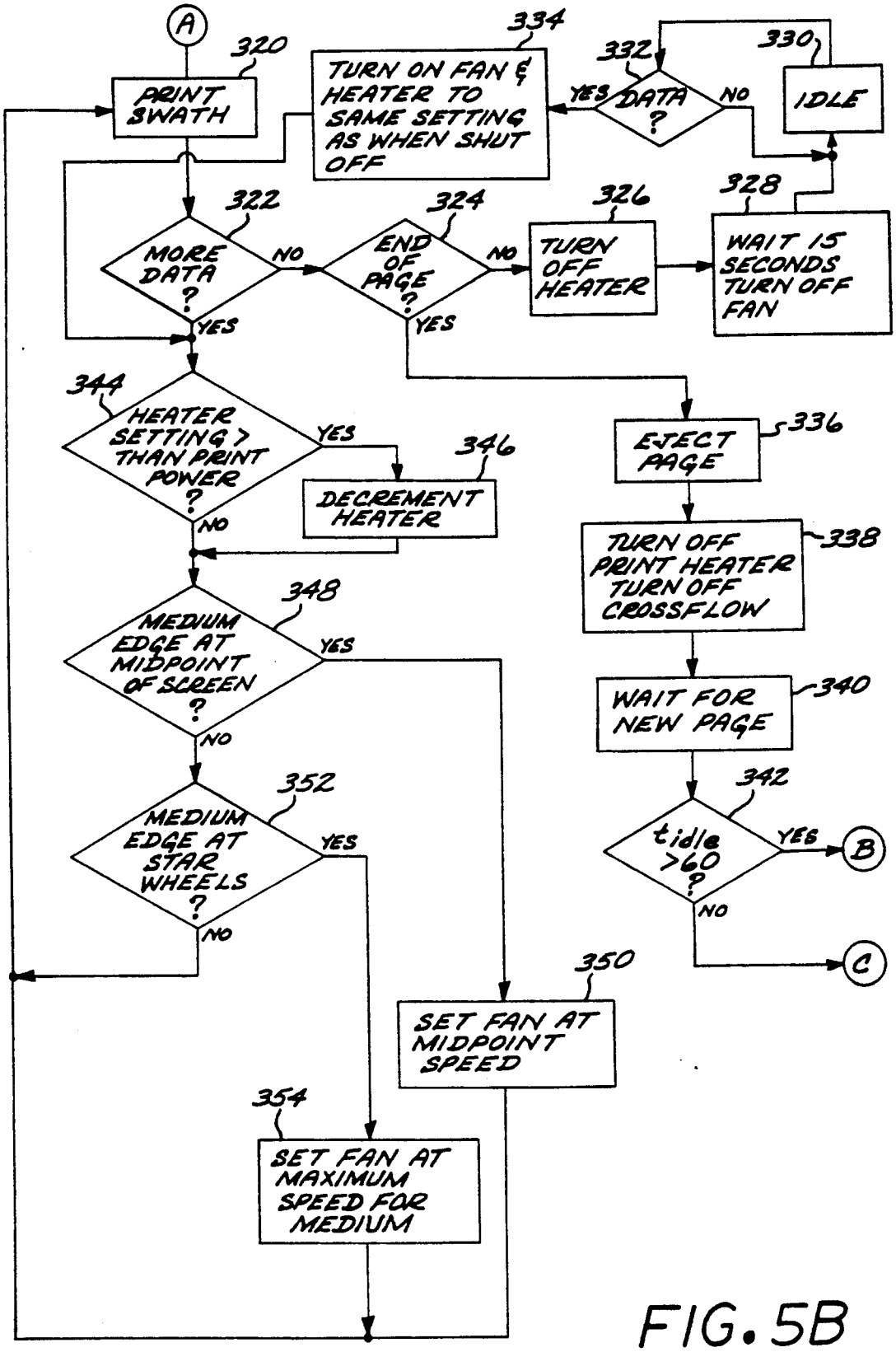

FIGS. 5A–5B illustrate an operational flow diagram for the printer 50 in accordance with the invention. At step 300, power to the printer is turned on, initiating the roller warmup algorithm (FIG. 2). Upon completion of the warmup phase of that algorithm and other initialization procedures, the printer checks for print data to be input to the printer from the host computer. Once input data is received, the printer preheat algorithm (FIG. 3) is initiated at step 306. At step 308, the print medium is loaded. This step includes actively aligning the leading edge of the medium at the drive roller and idler roller nip, rolling in the medium to the top of the drive roller, lifting the drive plate, pushing the medium onto the screen, and lowering the drive plate.

At this point, the print heater is turned off (step 310). If the medium is either glossy or transparent (based on the setting of the front panel switches or the print data from the host computer) (step 312), the sensor is used to find whether the medium is glossy or transparent. At step 314, the sensor is used to find the medium edges. The appropriate heater setting is selected for the particular type of medium loaded into the printer.

At step 318, printing commences. The heater bulb 72 is turned on, to a heating power setting dependent on the type of medium being printed. The crossflow fan is turned on, to a speed based on the position of the medium over the screen. The first swath is now printed (step 320) across the print medium. The printer now looks for more data defining the next swath to be printed, if any (step 322). If no more data has been received, an end of page check is performed (step 324). The print data from the host computer will typically include end-of-page flags or signals. The printer also includes a mechanical flag sensor (not shown) on the roller 62, disposed in the central peripheral groove thereof, which indicates when print medium is not in contact with the roller. If the end of the page being printed has not been reached, then the heater is turned off (step 326), and after a wait of 15 seconds, the crossflow fan is turned off (step 328). An idle stage (330) is maintained until new print data is received (322), at which time the heater and fan are turned on again to the same setting as when shut off (326, 328). Operation then proceeds to step 344.

If the end of the page has been reached (step 324), then the page is ejected from the printer (step 336), and the print heater and crossflow fan are turned off (step 338). The controller waits for receipt of new page data (step 340). Upon receipt of the new page data, if the idle time (tidle) exceeds 60 seconds, operation returns to B (step 306). If the idle time does not exceed 60 seconds, operation returns to C (step 308).

If more data has been received at step 322, operation proceeds to decision 344. If the heater setting is greater than the print power, the heater power is decremented (step 346). At step 348, if the medium edge is at the midpoint of the screen, the fan speed is set to the midpoint speed (step 350). The controller knows the position of the medium leading edge from the number of steps incremented by the drive motor 92 to advance the print medium. If the medium is not at the midpoint of the screen, then at step 352, if the medium edge is at the starwheels 102, the fan is set to the maximum speed for the print medium (step 354). If the medium is not at the starwheels 102, operation returns to step 320, to print another swath.

THE PRINT ZONE SCREEN 66

Figure 6:
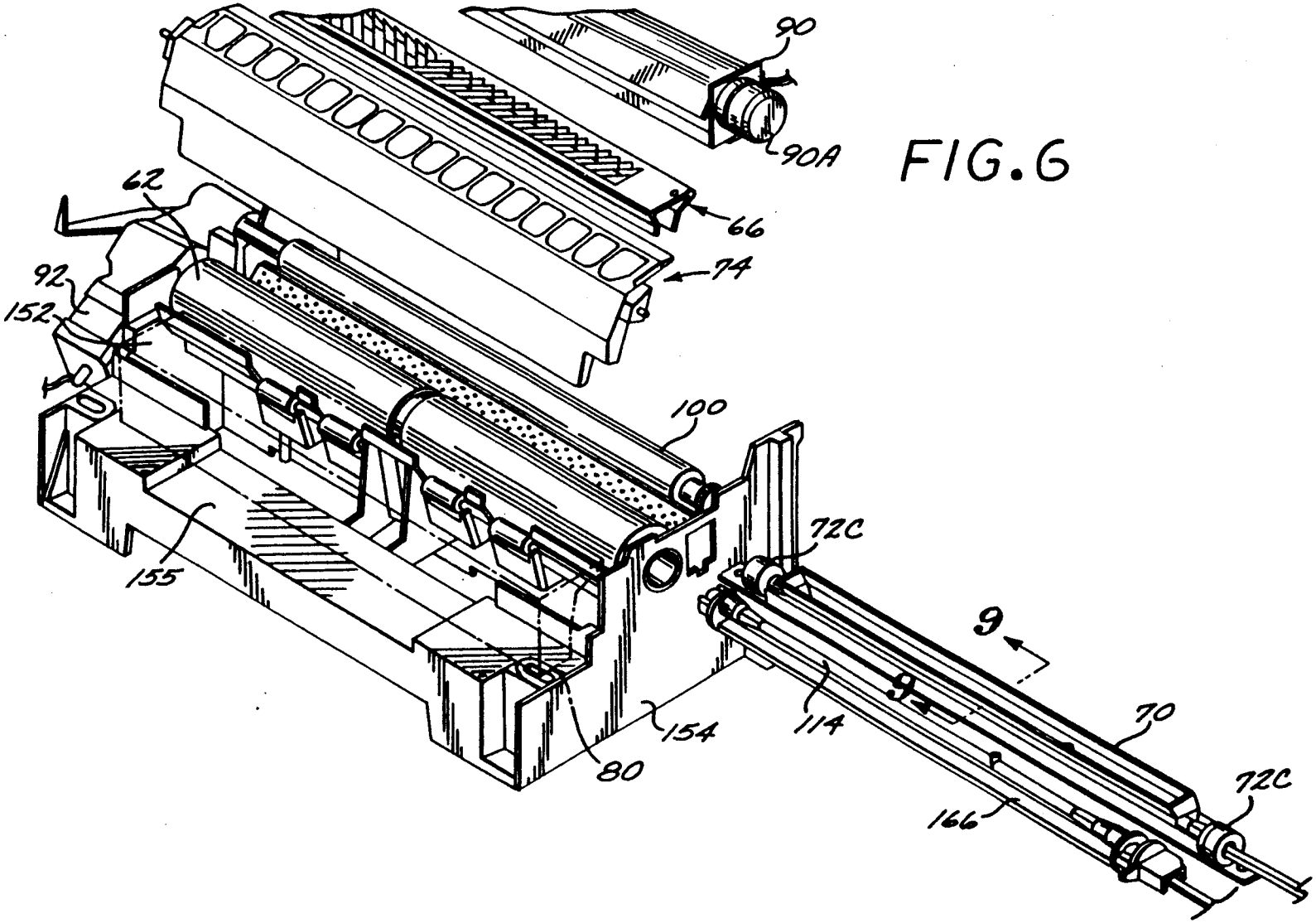
FIG. 6 is a partially-exploded perspective view showing various elements of the printer of FIG. 1, including the heated drive roller, print heater element and screen.
Figure 7:
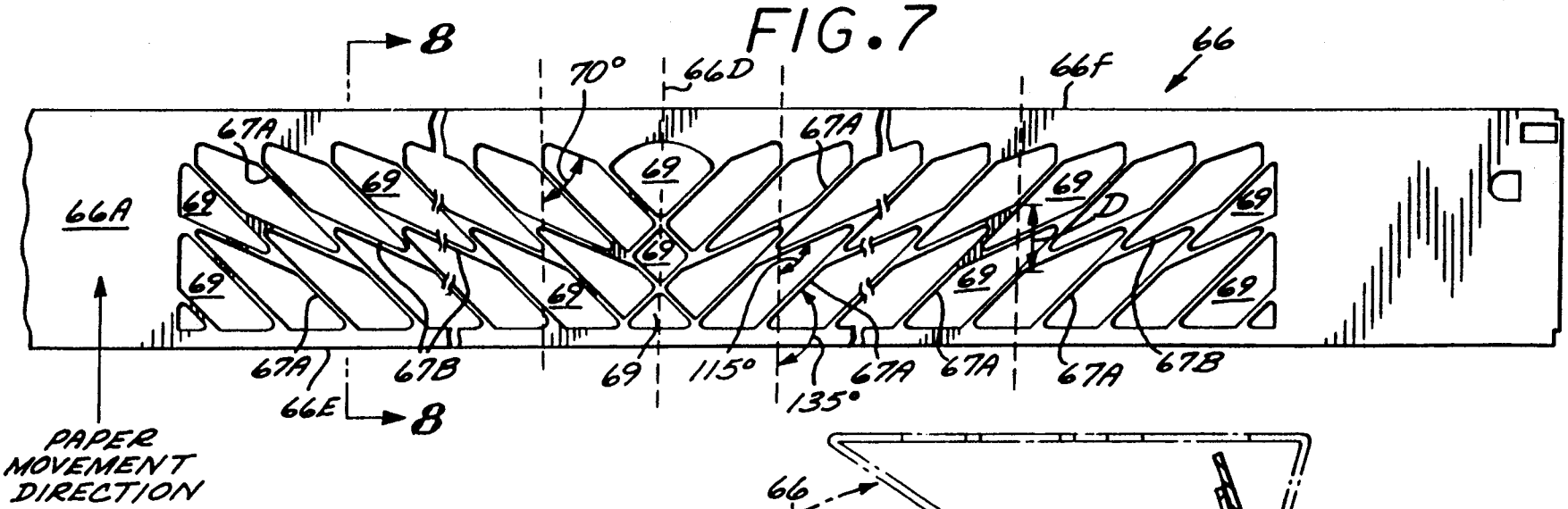
FIG. 7 is a top view of the heater screen of the printer of FIG. 1.
Figure 8:
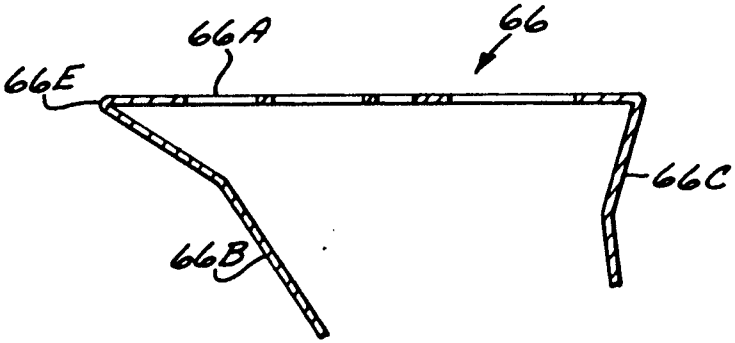
FIG. 8 is a side cross-sectional view of the heater screen, taken along line 8-8 of FIG. 7.

The print zone screen 66 in this embodiment is further illustrated in FIGS. 6, 7 and 8, and performs several functions. It supports the paper at the print zone and above the heater reflector 70. The screen is strong enough to prevent users from touching the heater element 72. The screen transmits radiative and convective heat energy to the print medium, while transmitting little if any conductive heat energy, which would cause print anomalies, due to nonuniform heat transfer. The screen 66 must be designed such that the print medium does not catch a surface of the screen as it is driven through the print zone.

The screen 66 performs these functions by the placement of a network of thin primary and secondary webs, nominally 0.030 inches in width, which outline relatively large screen openings. Exemplary ones of the primary and secondary webs are indicated as respective elements 67A and 67B in FIG. 7; exemplary screen openings are indicated as "69" in FIG. 7. The purpose of the secondary webs is to provide additional strength to meet safety requirements.

Figure 9:
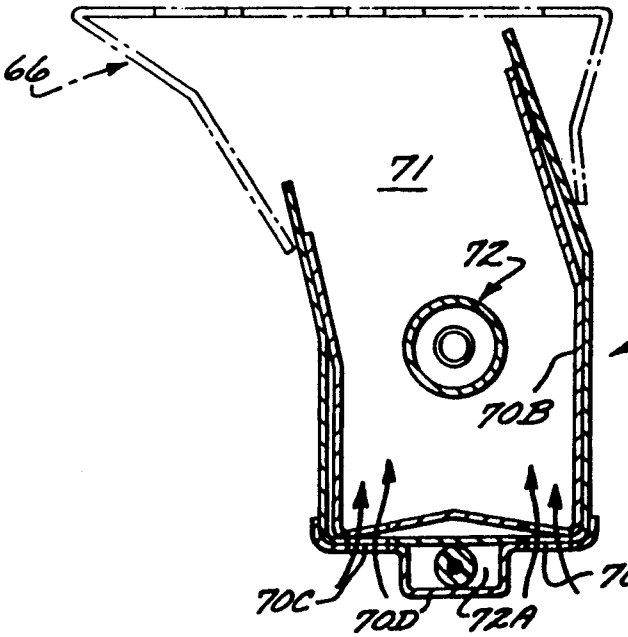
FIG. 9 is a side cross-sectional view of the print heater and reflector assembly, taken along line 9-9 of FIG. 6.

The screen 66 is preferably made from a high strength material such as stainless steel, in this embodiment about 0.010 inches in thickness. The openings 69 can be formed by die cutting or etching processes. The screen is processed to remove any burs which might catch the medium. FIG. 8 shows a cross-sectional view, and illustrates the top surface 66A which joins side flanges 6B and 66C. The screen fits over the top of the reflector 70 as illustrated in FIG. 9.

Typical dimensions for the screen include a screen opening pattern width (i.e., the dimension in the direction of medium travel) of 0.810 inches (20.5 mm), and opening 69 width and length dimensions of 0.310 inches (8 mm) and 0.470 inches (12 mm), respectively. The print zone width (in the direction of medium travel) for the exemplary printhead 52 of this embodiment is 0.530 inches (13.5 mm) covering the region subtended by three stagger print cartridges, each print cartridge employing 48 print nozzles aligned in a row.

Referring again to FIG. 7, the screen grid pattern is essentially a mirror image about the center axis 66D. Viewed from the edge 66E of the screen initially traversed by the print medium, the primary webs 67A are at a first obtuse angle relative to a line perpendicular to the edge 66E, which angle in this embodiment is 135 degrees. The secondary webs 67B are at a second obtuse angle relative to a line perpendicular to edge 66E, which in this embodiment is 115 degrees. The edges of the openings 69 which are adjacent the edge 66F of the screen are at a 70 degree angle relative to a line perpendicular to the screen edge 66E. These angles are selected in order to provide a web network which has the requisite strength to prevent users from touching the bulb 72 and yet which permits the ready transfer of radiant and convective heat energy from the radiator cavity to the print medium.

The angle of the primary webs 67A is determined by several factors. The web angles must first meet the requirement that the leading edge of the medium not catch on the webs as the medium is advanced. Also, the web angles are also selected in dependence on the medium advance distance between adjacent print swaths. This distance is determined by the number of print nozzles and the print mode. In this exemplary embodiment, the printhead comprises 48 print nozzles in a row, spaced over a distance of 0.160 inches (4.1 mm). Including the spacing between staggered cartridges, the total width of the area subtended by the printhead in this exemplary embodiment is 0.530 inches (13.5 mm). For a single pass mode the medium advance distance for each successive swath is 0.160 inches, i.e., the width of the area subtended by the print nozzle of a single one of the staggered print cartridges. For a three pass mode, the distance is one-third the single pass distance, or 0.053 inches. For the four pass mode, the distance is 0.040 inches, i.e., one-fourth the medium advance distance for the single pass mode.

The width of the screen opening pattern is determined in the following manner for this exemplary printer embodiment. The opening pattern width can be considered to have three regions, the first a pre-heat region for preheating the advancing medium before reaching the active print zone. The second region is the active print zone, i.e., the area subtended by the print nozzles comprising the printhead. In this embodiment, this area is defined by the nozzle coverage of three staggered print cartridges. The third region is a post-print heating region, reached by the medium after being advanced through the active print zone. In this embodiment, the pre-heat region width is equal to two multi-pass medium advancement distances; this is equal to 2(0.160 inches)/3, or about 0.105 inches. The active print zone region has a width of 0.530 inches, for the staggered three print cartridge embodiment, as described above. The post-print heating region has a width equal to a single pass mode increment distance, or 0.160 inches. The three regions aggregate approximately 0.8 inches in this embodiment.

The web angles are such that the vertical distance D between webs (i.e., the distance D on a perpendicular line to the screen edge 66E between webs as shown in FIG. 7) is not an integral multiple of the medium advance distance. This prevents the same point on the medium from being shielded from the heater cavity by adjacent webs in successive positions as the medium is advanced during printing. Such shielding would affect the drying rate slightly, and web patterns in the finished print copy could be seen if this shielding were not prevented. The problem is evident if one considers the use of vertical webs, i.e., webs which are parallel to the direction of advancement of the medium, which obviously would not catch the medium as it is advanced. However, the same areas of the medium, those disposed over webs, will be shielded from the print cavity as the medium is advanced, and this area will dry differently than unshielded areas, showing the vertical web pattern.

By way of example, the preferred embodiment, with a primary web angle of 135 degrees, employs a vertical spacing distance D between adjacent primary webs 67A of approximately 9 millimeters (0.355 inches), wherein a three pass medium advance distance is 1.4 millimeters(0.055 inches). This is about 6.4 advances, i.e., not an integral multiple.

THE PRINT HEATER

Figure 10:
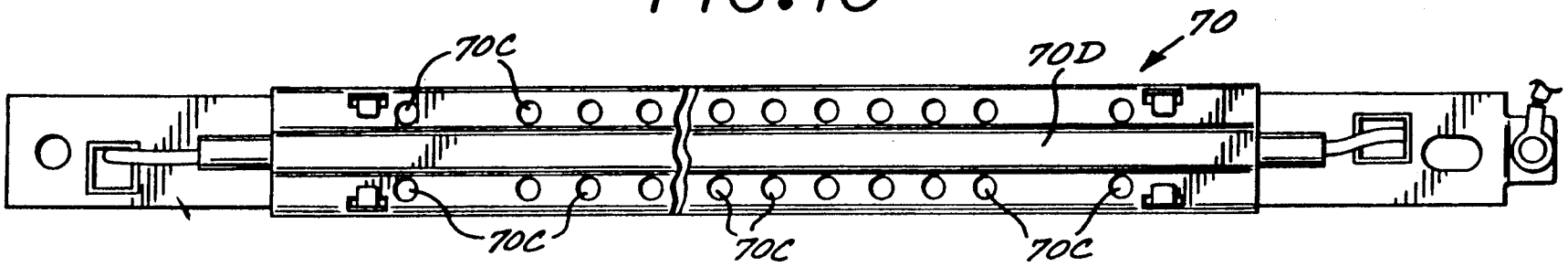
FIG. 10 is a bottom view of the heat reflector comprising the printer of claim 1.

The print heater bulb 72 and reflector are shown in FIGS. 6, 9 and 10 in further detail. The bulb 72 is a quartz halogen lamp, 13 inches in length. It is supported longitudinally at each end thereof within the reflector cavity 71 by conventional bushing elements 72C (shown in FIG. 6). In this exemplary embodiment, the lamp is a 90 volt, 200 watt bulb. A thermal fuse 72A is provided in the power circuit cable disposed in a channel 70D disposed at the bottom of the reflector 70, to comply with UL safety requirements.

The reflector 70 further comprises an inner liner 70B which has an inner surface which is highly reflective of infrared energy. The reflector 70 is fabricated from a material, such as galvanized steel, which can withstand the heat generated by the bulb 72, and which supports a highly reflective aluminum inner liner 70B to reflect the heat energy generated by the bulb toward the screen 66 which is assembled to the top of the reflector cavity. The bottom of the liner 70B is peaked under the bulb 72 so as to reflect energy directed downwardly by the bulb toward the sides of the liner for further reflection upwardly to the screen 66. Without the peak, some of such downwardly directed energy would be directed back to the bulb, blocking this portion of the heat from the screen, heating the bulb unnecessarily and wasting a portion of the heat energy.

As shown more clearly in the reflector bottom view of FIG. 10, a plurality of holes 70C are formed in both the reflector and its inner liner. In this embodiment, the holes in the reflector have a diameter of 0.125 inches (3.2 mm), and the corresponding holes in the reflector inner liner have a diameter of 0.100 inches (2.5 mm). Such holes provide a means for air to enter the bottom of the reflector and circulate upwardly through openings in the screen 66. The holes therefor increase the convective heat transfer from the reflector cavity 71 to the screen, and to allow cool air to flow into the cavity, thereby decreasing the maximum temperature of the assembly.

THE HEATED DRIVE ROLLER 62

Figure 12:
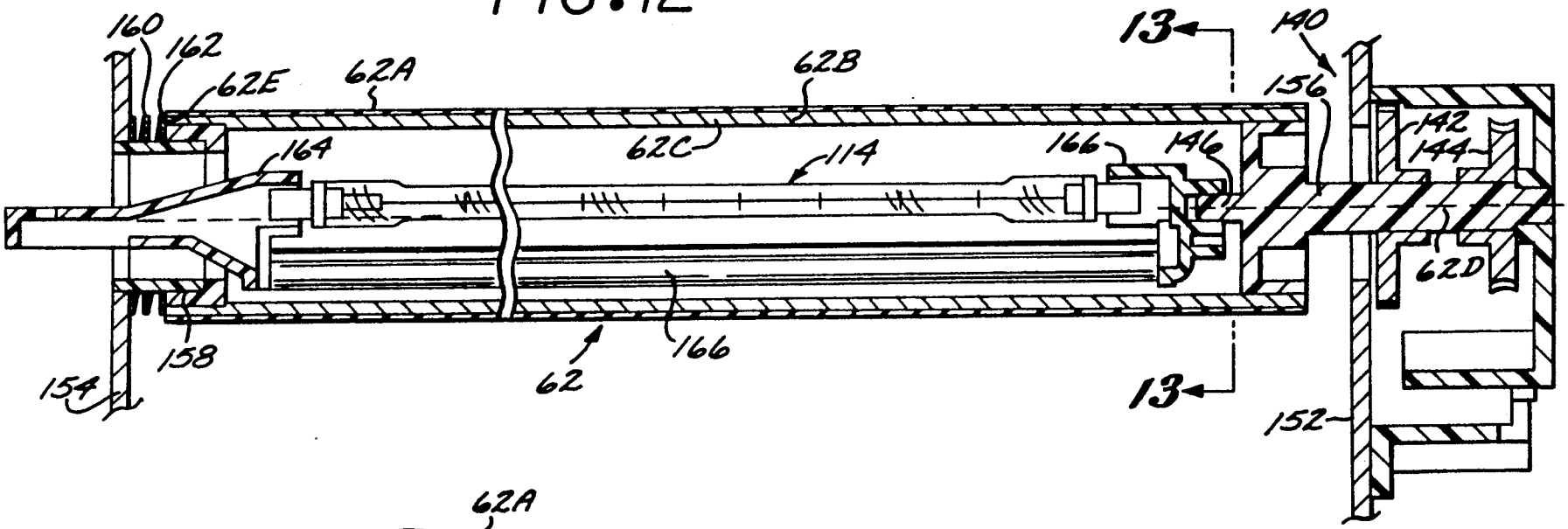
FIG. 12 is a side cross-sectional view of the heated drive roller comprising the printer.
Figure 13:
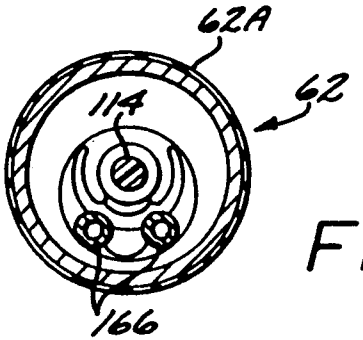
FIG. 13 is a an end cross-sectional view of the heated driver roller.

FIGS. 12 and 13 illustrate the drive roller in further detail. The roller comprises an aluminum roller 62B, on which a rubber coating 62A is formed to increase the coefficient of friction between the roller and the print medium. The aluminum wall provides good thermal conductivity resulting in a fairly isothermal surface. The interior surface 62C of the roller wall is black anodized to absorb infrared energy generated by the halogen bulb 114, fitted inside the roller wall 62B.

The roller wall 62B is rotatable on axis 62D by a gear train driven by the motor 92. The roller is supported by housing walls 152 and 154, with the gear train shaft 156 supported by a bushing (not shown). At the opposite end of the roller, a stationary bushing 158 slips into the open end of the roller wall 62B so that the end of the roller wall 62B slides or turns about the bushing 158. A spring 160 and friction washer 162 bias the end 62E of the roller toward the gear train end.

Polysulfone mounts 164 and 166 are used to mount the bulb 114 within the roller 62; polysulfone is used to withstand the high temperatures generated by the bulb 114. The bulb 114 in this exemplary embodiment is a 10 inch long, quartz halogen lamp selected to provide rapid warmup by using infrared energy. In this exemplary embodiment, a 108 volt, 270 watt bulb is used. To provide structural rigidity to the bulb mounting, an aluminum extrusion extends below the bulb 114 between the mounts 164 and 166. The extrusion has a natural aluminum finish to reflect infrared energy. A power wire runs in the extrusion channel between the bulb ends, with a thermal fuse is series with the wire to protect against overheating.

The polysulfone mount 164 is secured within stationary bushing 158. At the other end of the roller, mount 166 slip fits over a shaft 146, so that the mount and bulb assembly can rotate with respect to the shaft 146.

It may be seen that the bulb 114 is stationary with respect the roller wall 62B as the wall rotates to drive the print medium. This facilitates the task of providing electrical power to the bulb 114, permitting the power wires to be run through the stationary bushing 158 to the controller 130.

The roller heater is used to dry the medium under high humidity conditions before reaching the print heater. High humidity conditions, e.g., 70 percent relative humidity or higher, result in cellulose based media having a high moisture content. The heated drive roller drys some of this moisture from the medium before reaching the print zone. If the medium were not dried before the print zone, uneven shrinkage of the medium can occur when the medium is heated by the print heater at the print zone. This results because the part of the medium not at the print zone is not being heated, and the uneven heating of the different portions of the medium can cause buckling of the medium. The medium to nozzle distance can vary due to this buckling, and in extreme cases the buckled medium can actually contact the print nozzles, causing smearing. Thus the roller heater prevents uneven shrinkage of cellulose-based media.

THE ROLLER GEAR TRAIN AND DRIVE MOTOR

Figure 11:
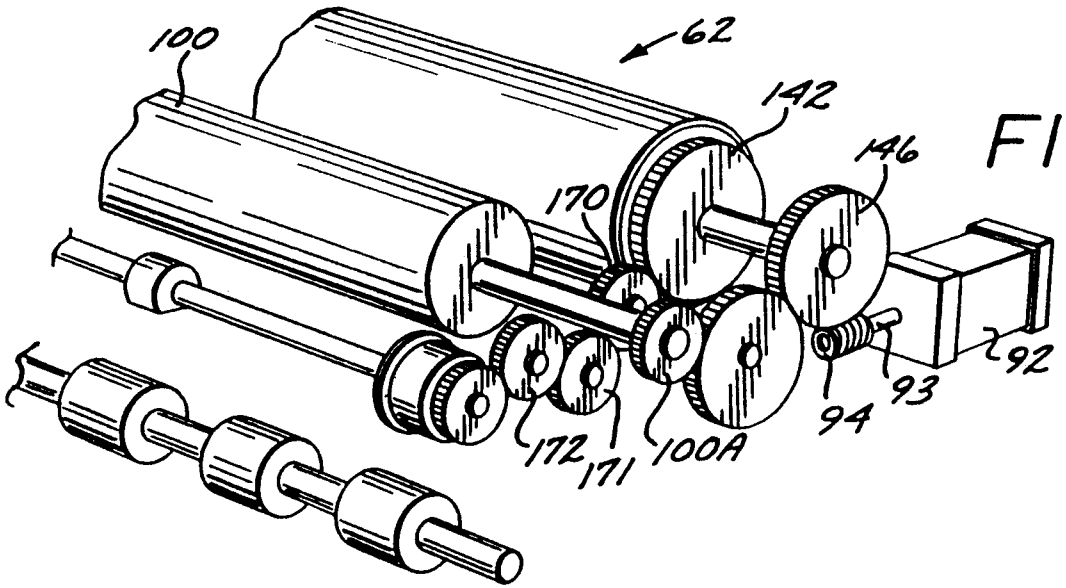
FIG. 11 is an exploded perspective view illustrating the gear train driving the printer rollers.

The roller gear train and drive motor interrelationship is illustrated in FIG. 11 in a simplified perspective view. The drive motor 92 is a stepper motor driven by a motor drive circuit comprising the controller 110. The motor shaft 93 has fitted on the end thereof a worm gear 94 which engages a helical gear 146 fitted on the drive roller shaft 156 (FIG. 12).

Also mounted on shaft 156 is a spur gear 142 which drives gears 100A and 103A through a series of idler gears 170–173. The diameters of the helical gear 146 and gear 100A are selected to turn roller 100 slightly faster than roller 62, in order to put tension on the print media when engaged by both rollers 62 and 100.

FIG. 6 is a partially exploded view of an assembly comprising the printer of FIG. 1, illustrating certain of the elements in the media drive path. The printer housing walls 152 and 154 and housing 155 provide a structure for supporting the drive roller 62, the exit roller 100, the drive plate 74 and reflector 70 as shown in FIG. 6. The preheat bulb 114 and its supporting structural element 166 can be accessed via an opening in the housing side wall. Similarly, the reflector 70 and bulb 72 can be accessed from another opening in the housing side wall 154.

THE PRINTHEAD AND CARRIAGE

Figure 14:
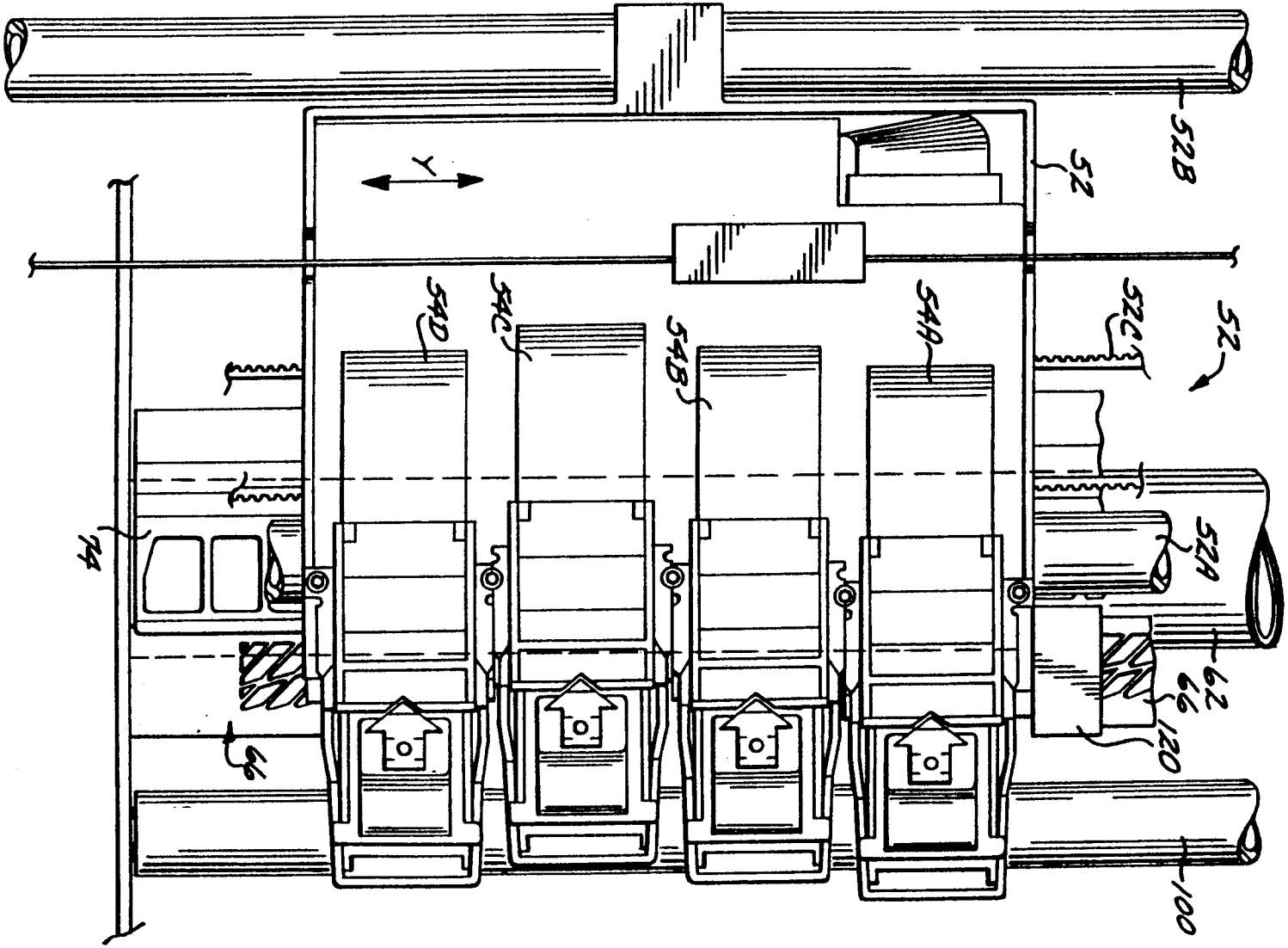
FIG. 14 is a top view illustrating the printhead of the printer of FIG. 1.

FIG. 14 illustrates a partially broken away top view of the printhead 52. The printhead 52 comprises the four thermal inkjet cartridges 54A–D. The printhead 52 is supported on parallel ways 52A and 52B for sliding movement along the ways. The printer includes a printhead drive means, including a drive belt 52C (driven by a dc motor, not shown) connected to the printhead 52 for driving the printhead along the Y direction to print swaths on the print medium supported below the cartridges 54A–D. (Other conventional motor and drive train elements for the printhead are not shown.)

The location of the sensor 120 on the printhead 53 is shown in FIG. 14. It is disposed directly above the surface of the screen 66. In this exemplary embodiment, the sensor senses infrared energy from an infrared LED which is reflected from the surface of the print medium at the print zone, and can sense the position of the medium edges. Such sensors are commercially available, such as the model EES133 marketed by Omoron Electronics, Inc., Minakuchi, Japan.

THE EXHAUST SYSTEM

Figure 15:
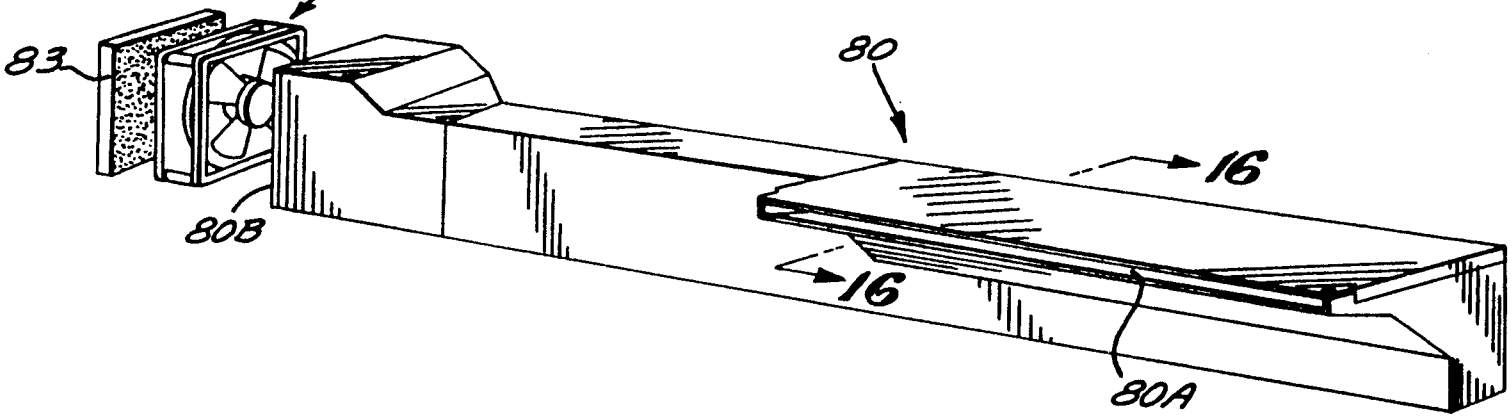
FIGS. 15 and 16 illustrate the exhaust fan and duct of the printer of FIG. 1.

FIGS. 15 and 16 illustrate the configuration of the exhaust duct 80 and exhaust fan 82. The duct 80 is elongated, with an intake port 80A positioned above the drive roller 62 and adjacent the print zone 56. The port 80A has a height dimension of about 0.17 inches in this exemplary embodiment. The exhaust fan 82 is positioned at the exhaust end 80B of the duct. A filter 83 is employed to trap solid particulate drawn from the exhaust duct by the fan 82. The fan size is chosen to exhaust air from the duct at a rate of about 10 cfm.

THE CROSSFLOW FAN

In this embodiment, the fan 90 is an elongated crossflow-type fan, mounted above the output side of the print zone 56 (FIG. 6). The fan 90 has a blade assembly length of 9 inches, and a blade assembly diameter of 1 inch in this embodiment. The fan extends across the swath width of the print zone, and in this embodiment provides an air velocity about 700 feet per minute at its highest RPM. The fan speed and operation is controlled by controller 110. This fan is driven by a dc motor 90A (FIG. 6). The drive signal to the motor 90A is pulse width modulated by the controller 110 to obtain the desired fan speed. A sensor 91 is coupled to the drive motor 90A and provides a motor speed signal to the controller 110. If the motor speed is less than the expected speed, indicating fan malfunction, the printer operation is shut down to avoid overheating the printer elements.

The crossflow fan 90 directs an airflow at the print zone and surrounding printer elements. The airflow creates turbulence at the print zone, which increases the ink carrier evaporation rate, and directs airflow toward the exhaust duct intake port 80A. The airflow also cools the printhead elements and other printer elements. When the print cartridge nozzles become too hot, larger ink dots are ejected than is desired. Moreover, the print nozzle laminate can become delaminated at very high temperatures.

THE CONTROLLER

Figure 17:
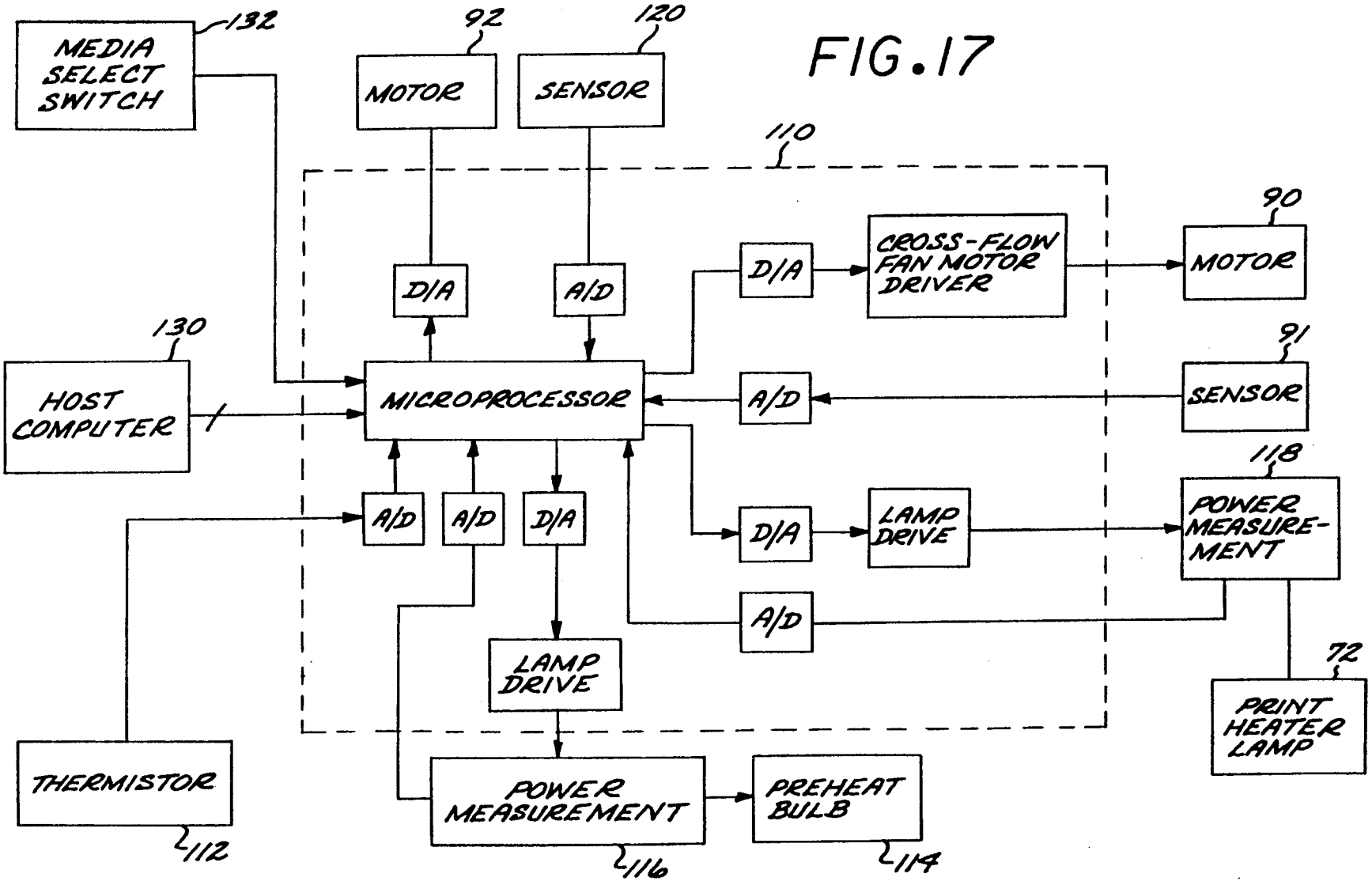
FIG. 17 is a simplified schematic block diagram of the controller comprising the printer of FIG. 1.

FIG. 17 illustrates the controller 110 in simplified schematic form. The various elements comprising the controller 110 are well known to those skilled in the art, and accordingly are not described herein in further detail.

AN ALTERNATIVE EMBODIMENT

Figure 18:
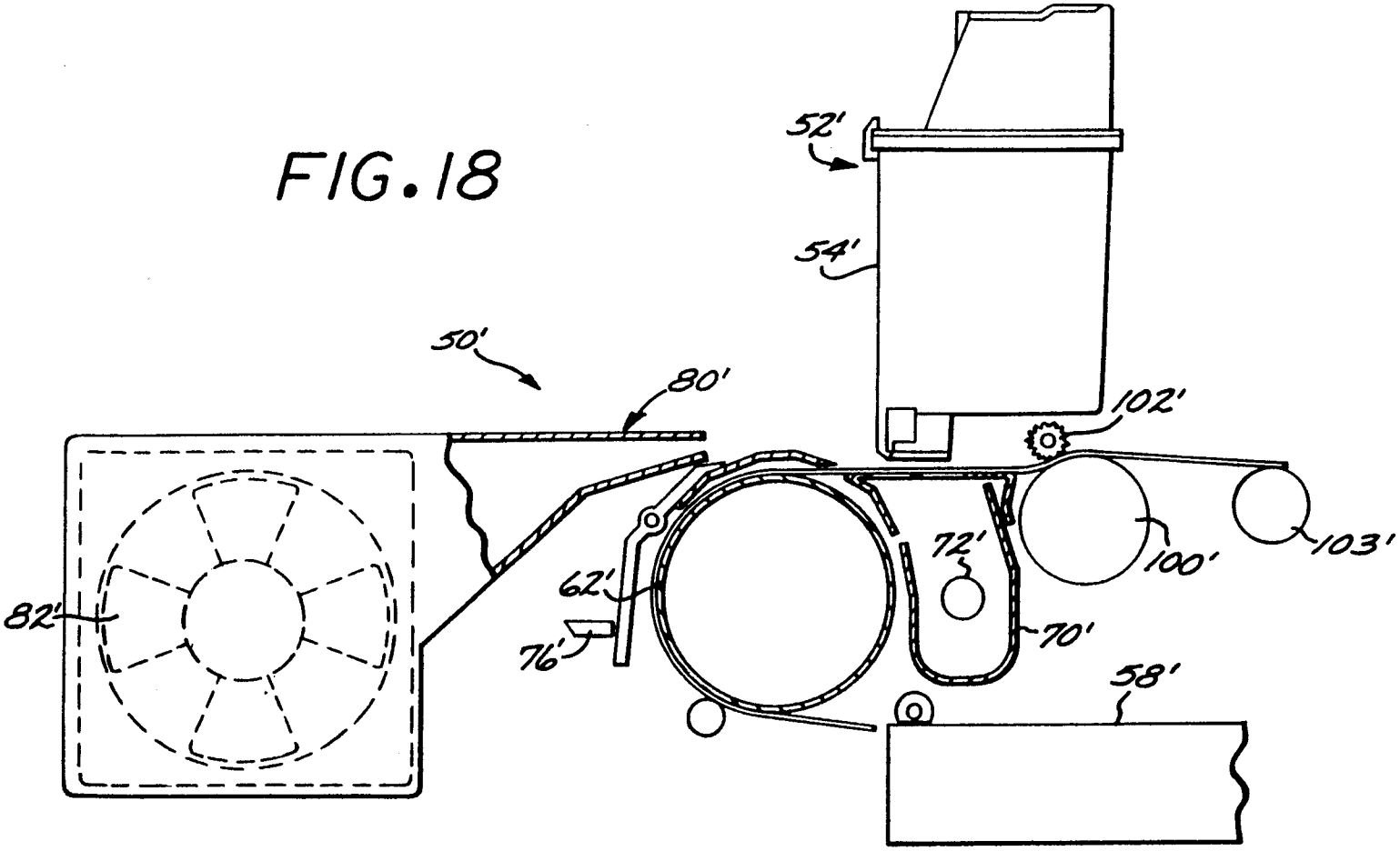
FIG. 18 illustrates an alternative embodiment of a color inkjet printer embodying the present invention.

FIG. 18 shows a simplified side schematic diagram of a printer 50' in accordance with this invention. This printer is identical to the printer 50 except that a crossflow fan is not employed in this embodiment, and the driver roller is not heated. Thus, a drive roller 62', a print heater comprising a reflector 70' and bulb 72', an exhaust duct 80', fan 82' and exit drive roller 100', starwheel roller 102' and output stacking roller 103' are employed as in printer 50 of FIGS. 1–17. The printer 50' operates in a similar manner as the printer 50, except that no roller preheated algorithm or crossflow fan algorithm is employed. This printer can be fabricated at lower cost than the printer 50.

The embodiment of FIG. 18 is simpler, less expensive to fabricate, less fragile (one less halogen bulb) and less costly to operate due to lower power requirements than the printer of FIGS. 1–17. The printer 50' is useful for applications permitting a decreased throughput rate than that achieved by the printer 50, since the heater output can be reduced in this instance, thereby eliminating the need for a crossflow fan. Also, such a printer 50' is useful for printing with inks having a lower carrier volume/ink drop, since this reduces the evaporation required to dry the ink. The drive roller heater can be eliminated for applications not concerned with high humidity conditions with the resultant high moisture content of cellulose based media, or if the print medium size is relatively small, say only A drawing size. The exemplary printer embodiment of FIGS. 1–17 can support both A and B sized print media, in contrast. The smaller sized medium will have less paper buckle due to uneven shrinkage of cellulose-based media, than will the larger sized medium. The effects of not having a drive roller heater can also be mitigated by using a wider screen with the same printhead nozzle spacing and size, so that the print heater warms a larger portion of the print medium adjacent the print zone.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A thermal ink-jet printer for printing onto a print medium, comprising:

a printhead for printing on a print medium, said printhead comprising a plurality of thermal ink-jet nozzles disposed above a print zone for ejecting jets of ink onto the surface of said medium in a controlled fashion;

means for advancing the print medium via a medium path to said print zone during print operations, said advancing means comprising a drive roller for engaging said medium, wherein said medium path comprises a path about a portion of an external circumferential surface of said drive roller, wherein said medium is wrapped about said portion of said external surface of said roller in the course of advancement of said medium to said print zone, said print zone being spatially separated from said drive roller;

print heater means disposed at said print zone for heating a portion of said print medium disposed at said print zone during printing operations to dry ink ejected onto said medium, and means for drying said print medium before said medium reaches said print zone to prevent uneven shrinkage of a cellulose-based print medium due to heating said medium at said print zone by said print heater means, said drying means comprising means for heating said roller external surface;

means for controlling the operation of said drying means to set said roller surface at a predetermined temperature range during printing operations; and means for controlling said print heater means to set said print heater at a heating range suitable for printing operations, and wherein said print heater means can be controlled to provide a higher temperature than said drying means.

2. The thermal ink-jet printer of claim 1 wherein said drive roller comprises a hollow roller, and said means for heating said roller external surface comprises an elongated bulb for generating infrared energy disposed within said roller.

3. The thermal ink-jet printer of claim 2 wherein said bulb comprises a quart halogen bulb.

4. The thermal ink-jet printer of claim 2 wherein said elongated bulb is fixed in position relative to said roller, and is stationary while said roller external surface is rotated.

5. The thermal ink-jet printer of claim 1 further comprising means for monitoring the temperature of said external surface of said roller, and means for controlling said drying means in dependence on said temperature monitoring means to maintain the temperature of said surface at a relatively constant temperature during print operations.

6. The thermal ink-jet printer of claim 1 further comprising controller means for controlling the operation of said drying means to preheat said roller surface prior to commencement of printing operations by said printer.

7. The thermal ink-jet printer of claim 6 further comprising temperature sensing means for providing a temperature sensor signal indicative of the temperature of said roller external surface, and wherein said controller means comprises means for causing said roller surface heating means to operate at a first relatively high power level for a predetermined time interval upon turning on the printer, and upon expiration of said time interval for causing said roller surface heating means to cycle between second and third power levels which are relatively lower than said first power level in dependence on said temperature signal, said cycling occurring in response to said temperature signal.

8. The thermal ink-jet printer of claim 6 wherein said roller is a hollow roller and said roller surface heating means comprises a heating element fixed in position within said hollow roller such that said heating element remains fixed while said roller is rotated, said printer further comprises roller drive means for rotating said driver roller, said roller drive means being controlled by said controller means, and wherein said controller means controls said drive means to rotate said roller without any print medium in engagement therewith during a predetermined warmup time prior to commencement of printing operations, said rotating of said roller serving to obtain a relatively uniform heating of said roller external surface.

9. The thermal ink-jet printer of claim 1 wherein said roller comprises a hollow roller further characterized by an internal circumferential roller surface, and wherein said surface is coated to increase absorption of infrared energy generated by said preheat means.

10. The thermal ink-jet printer of claim 9 wherein said hollow roller is fabricated from aluminum and said internal surface is black anodized to increase said absorption of infrared energy.

11. The thermal ink-jet printer of claim 1 wherein said roller external surface is coated with a rubberized coating.

12. The thermal ink-jet printer of claim 1 further characterized as a color printer, wherein said printhead comprises ink-jet cartridge means having a plurality of differently colored inks.

13. The thermal ink-jet printer of claim 12 wherein said ink cartridge means comprises a plurality of ink-jet cartridges each containing a supply of ink of different color from the other cartridge or cartridges.

14. The thermal ink-jet printer of claim 1 further characterized by an ink-jet print resolution of at least 180 dots per inch.

15. The thermal ink-jet printer of claim 14 further characterized by a print resolution of approximately 300 dots per inch.

* * * * *